United States Patent [19]

Chambers

[11] 3,971,106

[45] July 27, 1976

[54] PRONG-ATTACHED GARMENT FASTENERS DEVICES WITH BACKING MEMBERS

[75] Inventor: Brian Chambers, Birmingham, England

[73] Assignee: Thomas Walker Limited, Birmingham, England

[22] Filed: July 23, 1974

[21] Appl. No.: 491,089

[30] Foreign Application Priority Data

Aug. 4, 1973 United Kingdom ..... 37127/73

[52] U.S. Cl. ..... 24/227; 24/201 HE

[51] Int. Cl.[2] ..... A44B 13/00

[58] Field of Search ..... 24/226, 227, 229, 201 HE, 24/201 HH, 95

[56] References Cited

UNITED STATES PATENTS

| | | | |
|---|---|---|---|
| 281,992 | 7/1883 | Gilmore | 24/95 |
| 2,928,153 | 3/1960 | Reiter | 24/95 |
| 3,248,768 | 5/1966 | Silver | 24/225 |
| 3,283,382 | 11/1966 | Wood et al. | 24/227 |

*Primary Examiner*—Bernard A. Gelak

*Attorney, Agent, or Firm*—Neil F. Markva

[57] ABSTRACT

A backing member for a pronged garment fastener comprises a sheet-metal disc of spherically curved shallow dished configuration having a convex exterior surface and a concave interior surface. Integral tongue elements extend radially inwards from the periphery and lie in closely adjacent substantially abutting confronting relation with said concave interior surface within the concavity recess. The tongue elements have apertures which register with the prongs of the fastener and, adjacent said apertures, longitudinal groove or channel formations which extend radially inwards and which co-operate with the opposed concave interior surface to form pockets adapted to receive and accommodate the individual bent-over end portions of the prongs which are passed through said apertures and clenched against the concave interior surface.

10 Claims, 9 Drawing Figures

PRONG-ATTACHED GARMENT FASTENERS DEVICES WITH BACKING MEMBERS

BACKGROUND OF THE INVENTION

This invention relates to garment fastening devices of the kind comprising a pronged fastener component adapted to be applied to one face of a portion of garment fabric material, and a backing member adapted to be applied to the opposite face of said portion of garment fabric material. The pronged fastener component has integral attachment prongs which penetrate through the thickness of the garment fabric material and are clenched on said backing member to clamp the latter to the material and thereby firmly secure and anchor the fastener component in place.

The invention is especially concerned with the backing member structure and an object of the invention is to provide for such garment fastening devices an improved simple form of effective backing member adapted to cover and conceal the clenched prongs of the pronged fastener component. The pronged fastener component may, for example, be a pronged hook component of a garment hook-and-eye fastener for the waistbands of trousers or skirts.

Various forms of backing member structures have hitherto been proposed which provide a covered internal space forming a clenching recess or recesses to receive the prongs of a pronged fastener component and which have integral interior cam surfaces to clench the prongs into said internal space. But the structural desgins of many of these prior proposals have often been bulky and such that the internal space forming the clenching recess or recesses has been relatively large. The control and guidance provided for the prongs has been insufficient reliably to avoid an unacceptable high proportion of defective clenchings of the prongs and to ensure a clenched configuration of maximum effectiveness, especially in mass production use.

It will be appreciated that provision for the pronged fastener component of a permanent secure reliable anchorage which will not become loose or unduly weaken the garment material under the stresses of working conditions is a major practical requirement. Factors important in relation to the above requirement include (1) the ability of the backing member, when provided with integral cam clenching surfaces, to control and influence the manner in which the prongs are clenched, even if the prongs are initially slightly misaligned or distorted, (2) the ability of the backing member to maintain and distribute an effective clamping pressure upon the garment material, and (3) the mechanical strength and rigidity of the backing member which is relevant to the possibility of accidental deformation or distortion before or after use.

Backing members of the general form mentioned, which include integral clenching cam surfaces and which cover and conceal the clenched prongs are particularly preferred when it is required to secure a pronged fastener component to a fully made-up garment so that the prongs are passed through a full thickness of garment material and the backing member is positioned on an exterior surface and may, in use, be exposed to view. Consequently, overall size and shape, bulk, and close fitting against the garment material, are further important characteristics of backing members of this general form which affect the commercial acceptability of the product.

Having regard to all the above factors the desirability has been recognized of providing improvements in the overall structural design of such backing members.

SUMMARY OF THE INVENTION

According to the present invention, a backing member, for a pronged fastener component of a garment fastener device of the kind referred to, is composed of sheet-metal and comprises a sheet-metal disc having a dished configuration with a convex exterior surface and a concave interior surface. Integral with said body portion, tongue elements are directed toward the center of the disc so as to lie within the recess formed by the concavity of the concave interior surface and in confronting relationship adjacent to or in juxtaposition with said concave interior surface. The tongue elements have apertures to register with the prongs of the pronged fastener component. Adjacent said apertures and towards the center of the disc are longitudinally extending groove or channel formations which, in cooperation with said concave interior surface, provide pockets adapted to receive and closely confine the bent-over outer end portions of the prongs of the fastener component. In securing said fastener component the prongs, pass through the respective adjacent apertures so as to be clenched and deflected into said pockets by forcible engagement at an oblique angle with the concave interior surface of the body portion.

The depth of the recess formed by the concavity of the concave interior surface adjacent the center of the disc may be between 2 and 3 times the thickness of the sheet-metal of the disc so that an exceptionally shallow structure is formed. The dished configuration is preferably formed by a substantially spherical curvature which extends over substantially the whole area of the disc thereby providing a structure which has an exceptionally high mechanical strength and which is well adapted to fit flush and neatly against the surface of the garment material. Peripheral free edge surface portions of the body portion bound and extend between the concave interior surface and the convex exterior surface and are preferably adapted to confront obliquely the surface of the garment material to which the backing member is applied. Consequently, when in use, said surface portions bear upon and embed into said garment material under the influence of the clamping pressure from the clenched attachment prongs of the fastener component, thereby enabling and facilitating the convex exterior surface to lie substantially flush with the surrounding adjacent surface of the garment material.

It will be appreciated that the convex exterior surface of the body portion can provide a decorative appearance and may, if desired, carry an ornamental pattern, whereby the backing member can be quite suitable and acceptable for applying to an exterior surface of garment material, such as a garment waistband for example, in a position where it is likely to be exposed to view.

The apertures may conveniently be disposed substantially mid-way between the center and periphery of the disc so that the backing member may cover a substantially larger area than the area of the seating surface of the pronged fastener component between the prongs.

In preferred embodiments, the tongue elements are provided by a pair of diametrically opposite radial lugs integrally connected at their root ends with the body portion at the periphery of the disc. The lugs are folded back so as to extend towards one another along a diameter within the recess formed by the concavity of the disc. Surfaces of said lugs are in substantially abutting engagement or contact with the concave interior surface. Also, the pockets are preferably each adapted to accommodate a single clenched attachment prong of the pronged fastener component disposed longitudinally therein. The groove or channel formations are provided by grooves or channels having a depth commensurate with the thickness of the sheet-metal and having opposite side walls forming lateral guide surfaces engageable with oppsoite side edges of the prongs during clenching so as to restrain twisting or skewing during entry of the prongs into said pockets.

Backing members in accordance with this invention can advantageously be used in conjunction with fastener components in the form of pronged hook members, especially pronged hook members of a kind comprising an elevated cantilever hook tongue integrally connected to a longitudinally offset base portion which carries the prongs and provides a seating surface which lies against the surface of the garment material.

BRIEF DESCRIPTION OF DRAWINGS

Other objects of this invention will appear in the following description and appended claims, reference being made to the accompanying drawings forming a part of the specification wherein like reference characters designate corresponding parts in the several views.

DESCRIPTION OF SPECIFIC EMBODIMENTS

Figure 1:
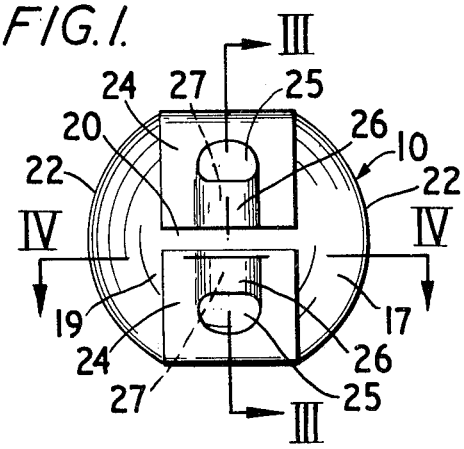
FIG. 1 is a rear elevational view of a first form of backing member, in accordance with the invention, for use with a pronged hook fastener component of a garment fastening device.

Referring first to FIGS. 1 to 5 of the drawings, the backing member 10 illustrated therein is designed for use with a hook fastener component 11 of a garment hook-and-eye fastening device suitable for connecting the ends of a waistband of a garment such as a pair of trousers or a skirt. The hook fastener component 11 has a single pair of parallel transversely spaced integral attachment prongs 12 extending perpendicularly from opposite peripheral edges of a base portion 13 which is integrally connected by a shallow step or cranking 14 to an elevated cantilever hook tongue 15 disposed in longitudinally offset relationship.

The backing member 10 is formed of sheet-metal, for example, sheet brass, and comprises a body portion 17 formed by a disc of the sheet-metal having a dished configuration with a convex exterior surface 18 and a concave interior surface 19. The curvature of the disc forming the body portion 17 is substantially spherical over substantially the whole area, and the concavity of the concave interior surface 19 forms a recess 20. The concave interior surface 19 and the convex exterior surface 18 are bounded by peripheral free edge surface portions 22 of the body portion 14 which extend between said interior and exterior surfaces 19 and 18.

The depth of the recess 20 adjacent the center of the disc of the body portion 14 is, as shown, between twice and three times the thickness of the sheet-metal.

The body portion 17 further has a pair of integral tongue elements 24 formed by a pair of diametrically opposite radial lugs integrally connected at their root ends with the body portion 17 at the periphery of the disc and folded back so as to be directed towards the center of the disc and to extend towards one another along a diameter within the recess 20. Surfaces of the tongue element lugs 24 confront and lie in substantially abutting engagement or contact with the concave interior surface 19. Thus, the tongue elements 24 are disposed at an angle with respect to each other.

Each tongue element 24 has an aperture 25 disposed substantially mid-way between the center and periphery of the disc body portion 17. Adjacent aperture 25 and towards the center of the disc body portion there is provided a longitudinally extending groove or channel formation 26, formed by a groove or channel of substantially rectangular cross-section, which, in co-operation with the concave interior surface 19, provides a pocket 27 adapted to receive and closely confine the bent-over outer end portion of a prong 12 of the hook fastener component passed through the adjacent aperture 25. It therefore follows from the disposition of the tongue elements 24 that the pockets 27 are formed at an angle with respect to each other.

Figure 3:
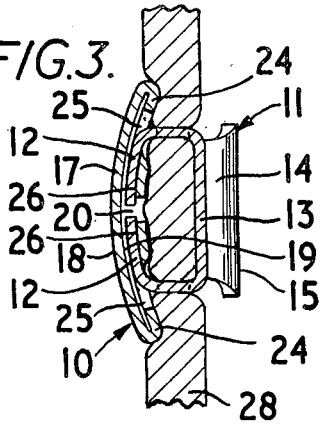
FIG. 3 is a section on line III-III of FIG. 1 showing the backing member in use for securing the pronged hook fastener component to garment material.
Figure 4:
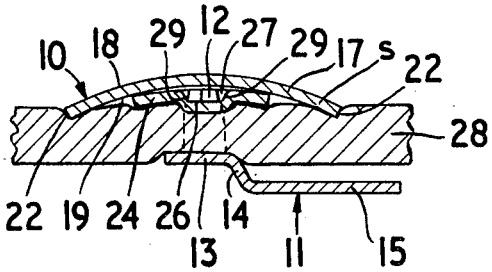
FIG. 4 is a sectional view similar to FIG. 3 but taken on line IV—IV of FIG. 1.
Figure 5:
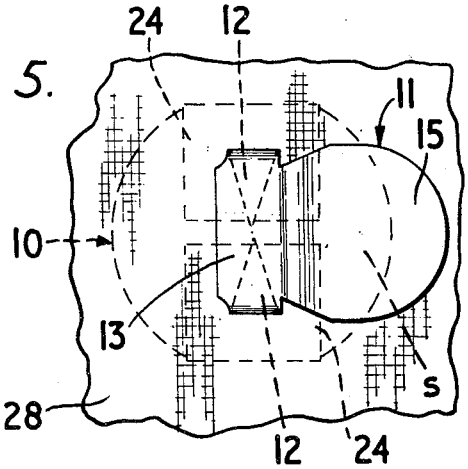
FIG. 5 is an elevational view of the hook fastener component attached to garment material by means of the backing member of FIG. 1.

In use, as indicated particularly in FIGS. 3 and 4, in attaching the hook fastener component 11 to a portion of garment material 28, the prongs 12 are forced through the garment material 28 from one side and then passed through the registering apertures 25 of the backing member 10 positioned at the opposite side. Under pressure exerted by a suitable press, the prongs 12 forcibly engage at an oblique angle with the concave interior surface 19 opposite to the apertures 25 and are deflected and bent-over towards the center of the disc body portion so as to enter the pockets 27 formed by the groove or channel formations 26 in co-operation with the confronting portion of the concave interior surface 19.

Figure 2:
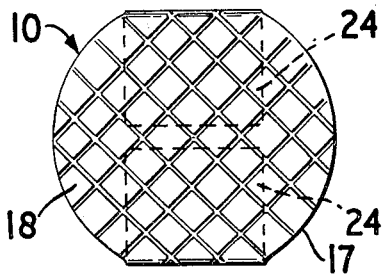
FIG. 2 is a front elevational view of the backing member of FIG. 1.

Thereby, the backing member 10 is clamped to the garment material 28 with the peripheral edge surfaces 22 of the disc body portion 17, which obliquely confront the opposed surface of the garment material 28, bearing upon and embedding into said material under the influence of the clamping pressure from the clenched attachement prongs 12. Clamping pressure is also transmitted to the garment material by confronting surface portions of the tongue elements 24 and the hook fastener component 11 is firmly secured or anchored in place with the attachment prongs 12 fully shielded and concealed from view. As is evident from the relationship of the confronting surface portions of tongue elements 24 and prongs 12, the clamping pressure is transmitted from prongs 12 through tongue elements 24 directly to the edge surface 22. Also, the convex exterior surface 18 lies substantially flush with the surrounding adjacent surface of the garment material 28, and a very effective and neat manner of fixing is achieved. As indicated in FIG. 2, the convex exterior surface 18 may be provided with a decorative ornamental pattern.

it will be seen that the groove or channel formations 26 of the tongue elements 24, 24, have a depth commensurate with the thickness of the sheet-metal of the backing member 10. This depth is substantially equal to the thickness of the sheet-metal forming the pronged fastener component so that the prongs 12 are forced to lie substantially flat in the pockets 27 and substantial curling of the prongs 12 within the pockets 27, which leads to potential weakness in the anchorage, is prevented. That is, the combination promotes flat surface contact between the prongs 12 and the interior surface 19. Also, the opposite side walls 29 of the groove or channel formations 26 form lateral guide surfaces engageable with opposite side edges of the prongs 12 during clenching so as to restrain twisting or skewing during entry of the prongs into said pockets.

When the hook fastener component 11 is secured to the garment material 28, the base portion 13 seats upon the surface of the material within an area opposite to the tongue elements 24 and lies fully within the area defined by the periphery of the backing member body portion 17. A relatively large area of the garment material is thereby involved in providing the anchorage for the hook fastener component, and, as indicated in the drawings, a segment *s* of the body portion 17 projects beyond the periphery of the base portion 13 so as to lie opposite to and in spaced relationship with the cantilever hook tongue 15 thereby to co-operate with said hook tongue in providing oppoosed relatively rigid jaws at opposite sides of the garment material to engage and confine the eye of a complementary staple or eye member.

The portion of garment material 28 illustrated may represent the end portion of the waistband of a pair of trousers or a skirt, for example, the side of the material to which the backing member 10 is applied being the exposed exterior surface of said waistband.

Figure 6:
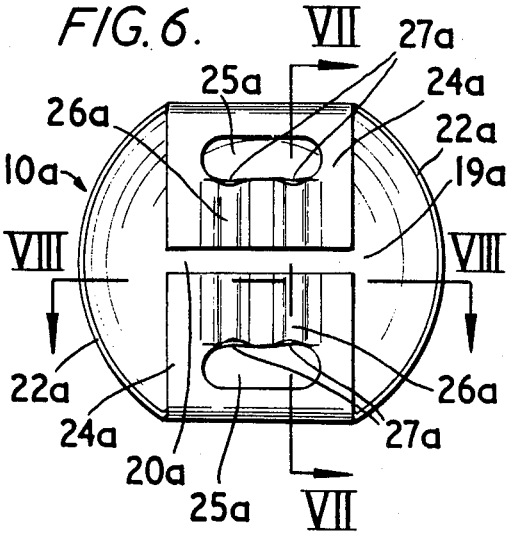
FIG. 6 is a rear elevational view of a second form of backing member, in accordance with the invention, for use with a modified form of pronged hook fastener component.
Figure 7:
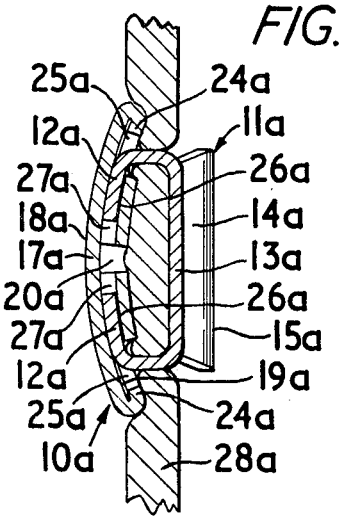
FIG. 7 is a section on line VII-VII of FIG. 6.
Figure 8:
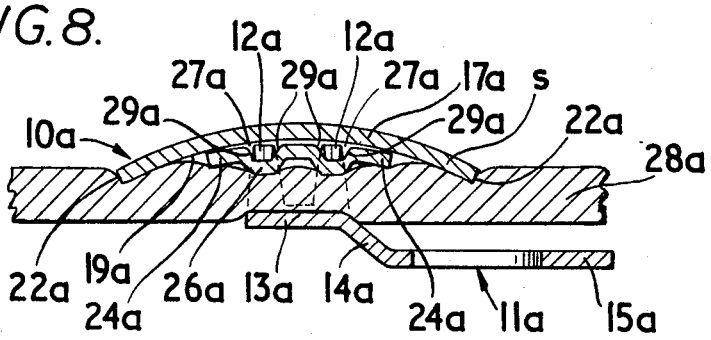
FIG. 8 is a section on line VIII-VIII of FIG. 6 showing the backing member in use for securing the modified pronged hook fastener component to garment material.
Figure 9:
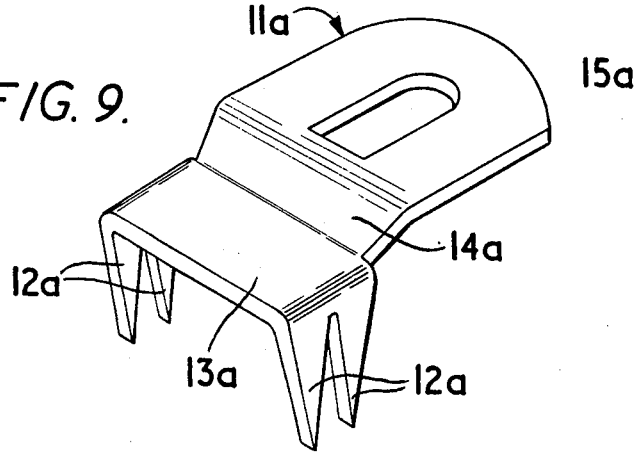
FIG. 9 is a perspective view of the modified form of hook fastener component used with the backing member of FIG. 6.

The second form of backing member illustrated in FIGS. 6 to 8 shows the manner in which the structure can be modified to suit a modified pronged hook component of the form shown in FIG. 9. The hook component 11*a* shown in FIG. 9 is generally similar to the first form of hook component 11 in that it has a cantilever hook tongue 15*a* integrally connected through a cranked step 14*a* to a longitudinally offset base portion 13*a*, but it differs in that the base portion 13*a* has two spaced apart pairs of side-by-side prongs 12*a*, 12*a*, in parallel relationship.

The modified form of backing member 10*a* is shown in FIGS. 6 to 8 and comprises a sheet-metal disc, constituting a body portion 17*a*, of shallow dished configuration, spherically curved over substantially its whole area. Again, the disc body portion 17*a* has a convex exterior surface 18*a*, a concave interior surface 19*a* defining by its concavity a recess 20*a*, and free peripheral edge surfaces 22*a*. And, again, a pair of tongued elements, 24*a* provided by a pair of diametrically opposed lugs integrally joined to the disc body portion 17*a* at the periphery. Lugs 24*a* are folded back to extend towards one another and lie within the recess 20*a* in closely adjacent substantially abutting confronting relationship with said concave interior surface 19*a*. Apertures 25*a*, located approximately mid-way between the periphery and center of the disc body portion, are formed in the tongue elements 24*a* adjacent groove or channel formations 26*a* extending longitudinally towards the center. In this modified form, the apertures 25*a* are each wide enough to receive a side-by-side pair of the prongs 12*a* and each groove or channel formation 26*a* comprises two separate side-by-side grooves or channels, of substantially rectangular cross-section, which in co-operation with the opposed concave interior surface 19*a* provide two side-by-side pockets 27*a* for the individual prongs 12*a* of each side-by-side pair which are restrained from twisting or skewing during entry into the pockets by opposite side walls 29*a* of the grooves or channels which form lateral guide surfaces.

Otherwise, the structure and manner of use of the backing member 10*a* in securing the pronged hook component 11*a* to garment material 28*a* is substantially the same as with the first embodiment.

I claim:

1. In a pronged garment fastener and backing member combination, a backing member comprising:

a. a sheet-metal disc constituting a body portion including a spherically curved shallow dished configuration having a convex exterior surface and a concave interior surface with a recess provided by the concavity of said concave interior surface;

b. tongue elements provided by diametrically opposed integral lugs extending radially inwards from the periphery towards the center of the disc;

c. said tongue elements lying within said recess and disposed at an angle with respect to each other;

d. apertures in said tongue elements to register with prongs of the pronged garment fastener; and e. groove formations in said tongue elements extending longitudinally from said apertures and toward the center of said disc;

f. said tongue elements having continuous edge portions extending from said periphery in substantially close proximity of said interior surface and said groove formations co-operating with the opposed concave interior surface to provide pockets disposed at an angle with respect to each other and adapted to receive and closely confine outer end portions of the prongs and promote a flat surface contact between the prongs and said interior surface;

g. securing the fastener to garment material, said prongs being forced through the garment material so as to pass into said apertures and to be deflected into said pockets by forcible engagement with the opposed said concave interior surface of the disc and thereby to be clenched causing the outer end portions to be bent over the tongue elements at said apertures.

2. A backing member according to claim 1, wherein the groove formations comprise narrow grooves having a depth substantially equal to the thickness of the sheet-metal whereby the pockets are each adapted to accommodate and closely confine a single clenched attachment prong, and said grooves have opposite side walls providing lateral guide surfaces engageable with opposite side edges of the prongs during clenching so as to restrain twisting or skewing during entry of the prongs into said pockets.

3. A backing member according to claim 2, wherein the groove formation of each tongue element comprises a pair of grooves disposed side-by-side in close parallel relationship so as to receive prongs of the garment fastener which are disposed in similar side-by-side close parallel relationship.

4. A backing member according to claim 1, wherein the recess of the disc, within which the tongue elements are accommodated, has a depth adjacent the center of the disc between double and treble the thickness of the sheet-metal.

5. A backing member according to claim 1, wherein the apertures of the tongue elements are disposed substantially midway between the center and periphery of the disc.

6. A backing member according to claim 1, wherein the disc has narrow peripheral free edge portions which slope obliquely so as to bear upon and embed into the garment material to which the backing member is applied in use under the influence of the clamping pressure from the clenched attachment prongs, whereby the convex exterior surface lies flush with the surrounding adjacent surface of said garment material.

7. A pronged garment fastener and backing member combination comprising:

a. a pronged hook fastener having an elevated cantilever hook tongue, b. a base disposed in longitudinally offset relationship with said hook tongue, c. step means integrally connecting said hook tongue to said base, d. integral attachment prongs protruding from said base, e. a seating surface provided by said base to support the hook fastener, upon garment material to which it is attached in use, and f. a backing member which has a structure in accordance with claim 1, g. the disc body portion having an area larger than the area of said base of the hook fastener and having a segment which projects beyond the periphery of said base to lie opposite to and in spaced relationship with the cantilever hook tongue thereby to co-operate with said hook tongue to provide opposed relatively rigid jaws for engaging and confining the eye of a complementary staple or eye member.

8. A garment fastener and backing member combination comprising:

a. said garment fastener including prongs, and b. said backing member including a dished disc member having an outer rim portion and diametrically opposed integrally formed lug members extending inwards from said rim portion towards the center of the disc member, c. said disc member having a concave interior surface which forms a recess, d. said lug members including apertures and groove formations extending longitudinally with respect to the lug members in a direction away from the apertures, e. said lug members having continuous edge portions extending from said outer rim and lying within the recess in closely adjacent confronting relationship with the concave interior surface to form pockets disposed at an angle with respect to each other for receiving and closely confining said prongs during and after a clenching together of the fastener and backing member on a garment material, f. said pockets being effective to guide and contain said prongs being forced through the garment material into said apertures and being disposed substantially flat against said concave interior surface, g. the prongs when disposed within said pockets being effective to facilitate the embedding of said outer rim portion into the garment material by transmitting clamping pressure from the prongs through the lug members directly to said outer rim portion.

9. A combination according to claim 8, wherein said backing member is composed of sheet-metal and is sperically curved with a convex exterior surface.

10. A combination according to claim 8, wherein said groove formations include a pair of grooves disposed side-by-side in parallel relationship on each lug member, said prongs having a corresponding side-by-side parallel relationship to be disposed within the pockets formed by said parallel grooves.

* * * * *